US007793586B2

(12) United States Patent
Rabas

(10) Patent No.: US 7,793,586 B2
(45) Date of Patent: Sep. 14, 2010

(54) REMOVABLE BLOWER FOR CONVECTION OVEN

(75) Inventor: Jiri Rabas, Lynnwood, WA (US)

(73) Assignee: G.S. Blodgett Corp., Burlington, VT (US)

( * ) Notice: Subject to any disclaimer, the term of this patent is extended or adjusted under 35 U.S.C. 154(b) by 604 days.

(21) Appl. No.: 11/829,570

(22) Filed: Jul. 27, 2007

(65) Prior Publication Data

US 2008/0210102 A1 Sep. 4, 2008

Related U.S. Application Data

(60) Provisional application No. 60/834,871, filed on Aug. 2, 2006.

(51) Int. Cl.
*B64C 11/06* (2006.01)
*A47J 27/10* (2006.01)

(52) U.S. Cl. ..... 99/476; 416/208; 416/214 R; 416/220 R

(58) Field of Classification Search ..... 99/476, 99/475, 474, 473; 219/400; 416/214 R, 416/210 R, 220 R, 244 R, 208, 207; 192/69.71, 192/108; 415/121.3, 201, 206, 214.1, 204; 310/89, 257, 71, 67 R, 263

See application file for complete search history.

(56) References Cited

U.S. PATENT DOCUMENTS 2,156,047 A * 4/1939 Arnold et al. ..... 464/47
2,609,058 A * 9/1952 Place ..... 416/204 R
3,005,497 A * 10/1961 Klonoski et al. ..... 416/134 R
3,409,489 A * 11/1968 Renton ..... 156/60
4,173,429 A * 11/1979 Hoffman et al. ..... 416/184
5,590,583 A * 1/1997 Harrison ..... 99/327

OTHER PUBLICATIONS

Blodgett—DFG 100 & DFG 200 Series Gas Convection Oven Replacement Parts List, dated Oct. 16, 2007.
Blodgett—DFG 100 XCEL Series Gas Convection Oven Replacement Parts List, dated Mar. 6, 2006.

* cited by examiner

*Primary Examiner*—Reginald L Alexander
(74) *Attorney, Agent, or Firm*—Brinks Hofer Gilson & Lione

(57) ABSTRACT

An convection oven with a removable blower wheel system is provided. The oven includes motor with a corresponding motor shaft, a first hub engageable with the motor shaft, a blower wheel, and a second hub. Each of the first hub, blower wheel, and second hub include corresponding radial apertures formed in consistent positions on each component. A plurality of shafts extend through each of the first and second hubs and the blower wheel to cause the three components to rotate together.

20 Claims, 8 Drawing Sheets

REMOVABLE BLOWER FOR CONVECTION OVEN

CROSS-REFERENCE TO RELATED APPLICATIONS

This application claims priority from U.S. Provisional Application Ser. No. 60/834,871, filed on Aug. 2, 2006, the entirety of which is hereby fully incorporated by reference herein.

TECHNICAL FIELD

The present disclosure relates to the field of ovens to heat food products. Specifically, the present disclosure relates to blower wheels for convection ovens.

BACKGROUND

Certain types of convection ovens may provide a flow of heated air to surround a food product to be cooked in addition to providing radiant heating to cook the food product. A blower wheel within the internal housing of the oven that is rotatable during operation of the oven may be used to urge the forced convection air flow.

Blower wheels that are provided in convection ovens are normally rotated by torque produced in an output shaft of a motor. When mounting the blower wheel to the output shaft, structure is required to prevent the motor shaft from rotating with respect to the blower wheel. One technique is to provide a spline on the motor shaft with a corresponding recess in the internal central hole of the blower wheel to prevent this relative rotation. Apertures are typically provided in each of the motor shaft and the blower wheel to receive one or more set screws.

Convection ovens are often used the commercial food service industry. Many geographic regions have laws and/or regulations that require commercial food service entities to maintain some baseline level of cleanliness within the equipment that is used to prepare and cook food that is sold to consumers. These regulations often include the requirement to pass periodic and surprise on-site inspections from government officials. Accordingly, there is a need for the establishments in the commercial food service industry to maintain a program to ensure that their equipment used to prepare and cook food is adequately clean and sanitary, to comply with government regulations and customer understanding that cleanliness and sanitation is an important aspect of their operations.

Blower wheels must often be removed from the motor shaft to repair or replace the blower wheel or other associated components of the convection oven or to provide space for cleaning the internal volume of the oven. It is difficult and time consuming to remove conventional blower wheels from a motor shaft, often requiring a relatively complex procedure and specialized tools for removal, alignment, and replacement of the blower wheel. Accordingly, it is desired to provide removable blower wheel for a convection oven that is relatively easy to remove, replace, and align, such that the commercial food service personnel can successfully and efficiently perform these tasks.

BRIEF SUMMARY

In order to address the deficiencies of prior convection ovens discussed above, an oven and method of use are described below.

A removable blower wheel assembly is provided that includes a first hub including a disc portion and a protruded portion, wherein a central aperture is defined through the disc and protruded portions. The disc portion is configured to receive a plurality of shafts that extend in parallel to the protruded portion. A blower wheel defines a central hole and a plurality of first apertures defined around the central hole, wherein the protruded portion of the first hub extends through the central hole. A second hub includes a disc portion and a protruded portion, wherein the protruded portion of the first hub extends within and through the protruded portion of the second hub, and a plurality of second apertures are defined in the second hub. A plurality of shafts extend through the respective plurality of first and second apertures.

A convection oven is provided that includes a housing defining an internal cooking region and a motor with an output shaft that rotates during motor operation. A first hub includes a disc portion and a protruded portion and a central aperture is defined through disc and protruded portions. The disc portion is configured to receive a plurality of shafts aligned in parallel to the protruded portion. A blower wheel is provided with a central hole and a plurality of first apertures disposed radially outward from the central hole, wherein the protruded portion of the first hub extends through the central hole. A second hub includes a disc portion and a protruded portion, wherein the protruded portion of the first hub extends within a portion of the protruded portion of the second hub, wherein the second hub defines a plurality of second apertures, wherein the plurality of shafts extend through the respective plurality of first and second apertures when a portion of the output shaft extends through the first and second hubs and the blower wheel.

A removable blower wheel assembly is provided that includes a first hub including a disc portion and a protruded portion, wherein a central aperture extends through the disc portion and the protruded portion. A blower wheel defines a central hole to accept the protruded portion of the first hub. A second hub is provided that includes a disc portion and a protruded portion, wherein the protruded portion of the first hub extends within the protruded portion of the second hub. A means to removeably connect each of the first hub, the blower wheel, and the second hub is additionally provided.

Advantages of the disclosed oven and methods of use will become more apparent to those skilled in the art from the following description of embodiments that have been shown and described by way of illustration. As will be realized, other and different embodiments are contemplated, and the disclosed details are capable of modification in various respects. Accordingly, the drawings and description are to be regarded as illustrative in nature and not as restrictive.

BRIEF DESCRIPTION OF THE DRAWINGS

FIG. 10 is an exploded view of an alternate removable blower wheel.

DETAILED DESCRIPTION

Figure 7:
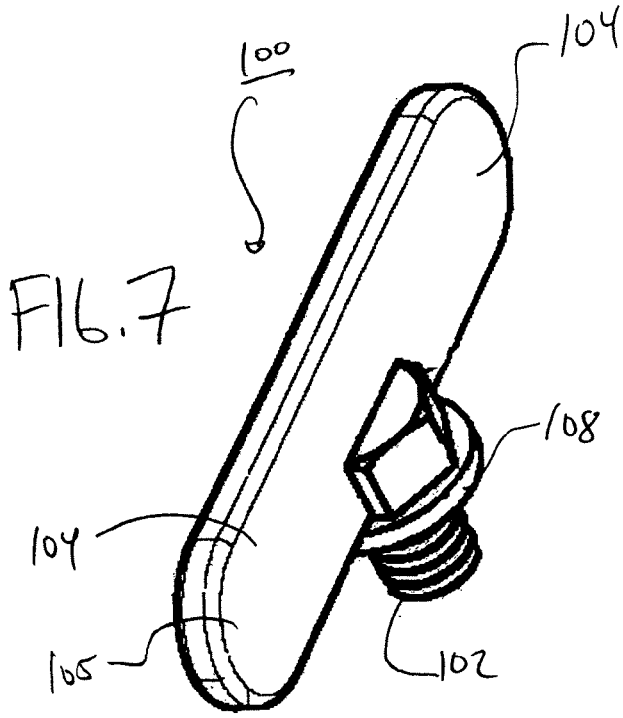
FIG. 7 is a perspective view a fastener of FIG. 1.
Figure 8:
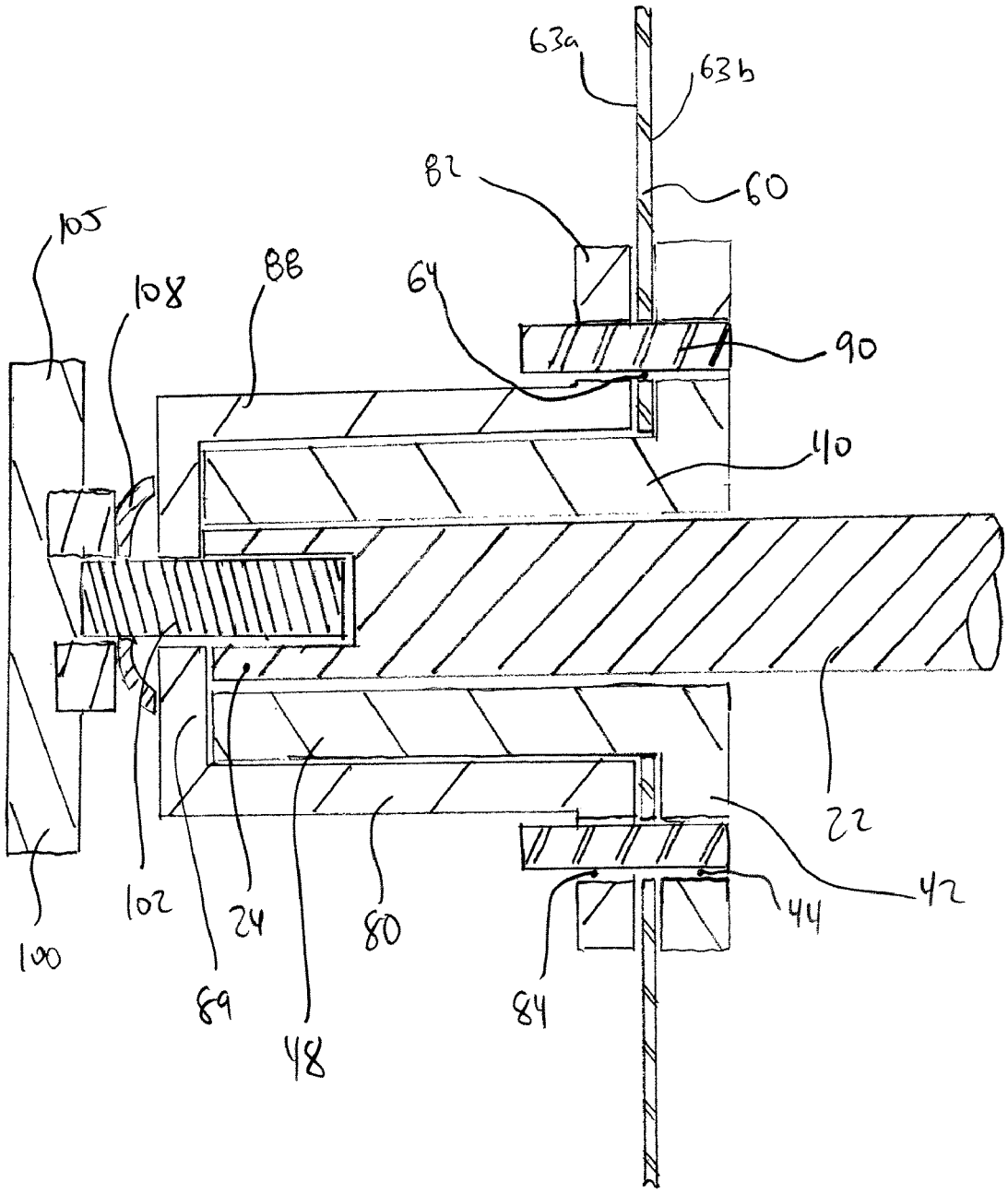
FIG. 8 is a cross-sectional view of the assembled removable blower wheel of FIG. 1.
Figure 9:
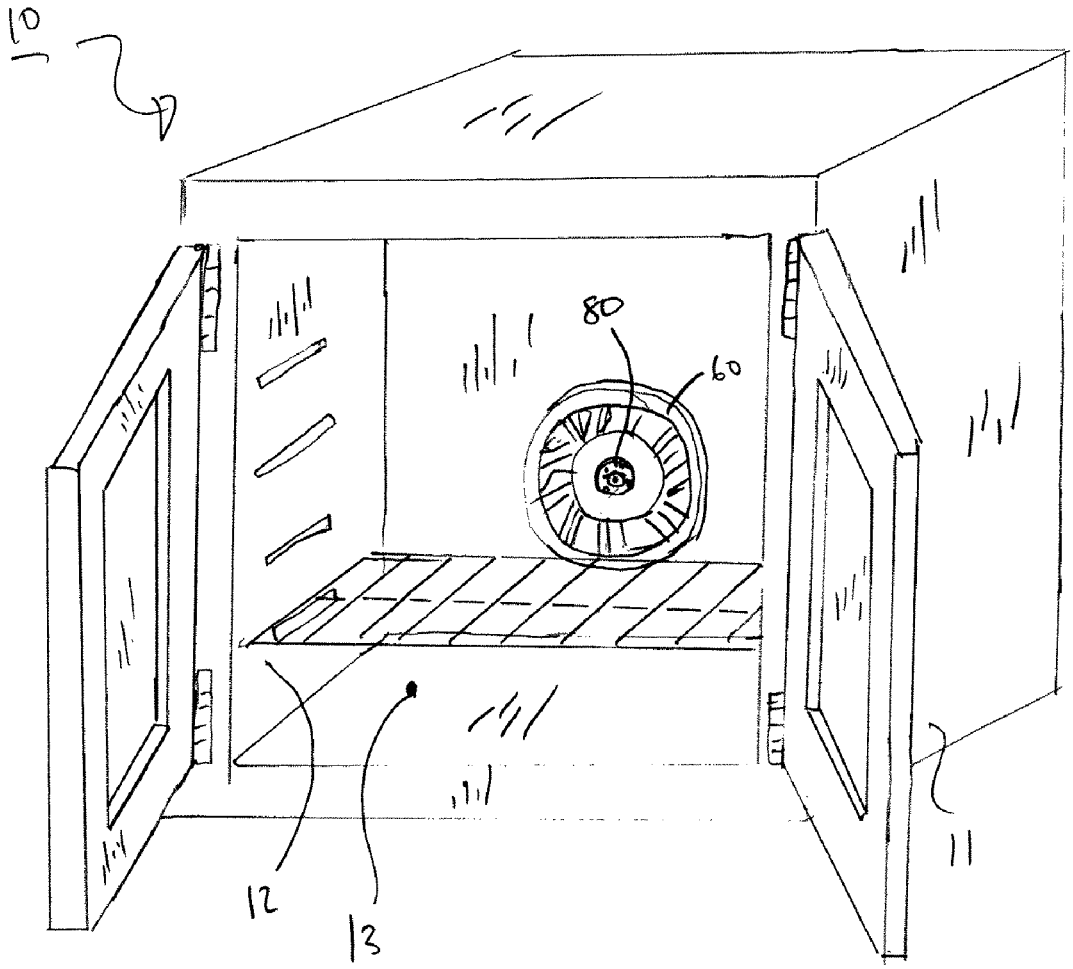
FIG. 9 is a perspective view of the removable blower wheel installed within a convection oven.

Turning now to FIGS. 1-9 and specifically to FIG. 9, a removable blower wheel system 10 for use with a convection oven 11 is provided. The removable blower wheel system 10 includes a motor 20 with output shaft 22, a first inner hub 40, a blower wheel 60, and a second outer hub 80. The removable blower wheel system 10 is normally included within an oven housing 12 that forms an internal cooking volume 13. The motor 20 and output shaft 22 are positioned within the housing 12 such that as the blower wheel 60 rotates due to the torque provided by the motor 20 through an associated motor shaft 22, causing forced air flow through the convection oven 11. The air within the convection oven 11 is normally heated by radiant heaters (not shown). The heated air flowing past a food product within the cooking volume 13 causes heat to transfer from the air to the food product due to convection heat transfer.

The motor 20 and its associated shaft 22 are normally positioned such that the motor shaft 22 extends into the inner housing 12 of the oven. The distal output end 24 of the motor shaft 22 includes a recessed portion 26, which may include female threads or other connection structures known in the art. The output shaft 22 additionally may include a key 28, spline, or similar structure adapted to mate with an opposing keyway or spline to cause the torque within the motor shaft 22 to be transferred to the opposing structure. In other embodiments, the distal end 24 of the motor shaft may include flat surfaces formed within the round shaft that mate with corresponding flats in the opposing structure to transfer torque. In still other embodiments, the motor shaft 22 may be formed or provided with other structures known to those of ordinary skill in the art.

Figure 3:
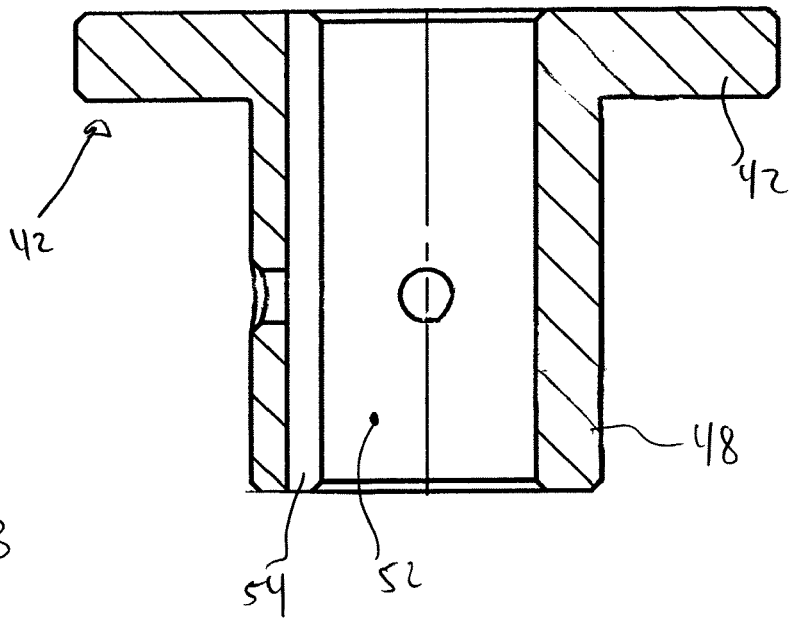
FIG. 3 is a cross-sectional view of the inner hub of FIG. 2 along section 3-3.
Figure 2:
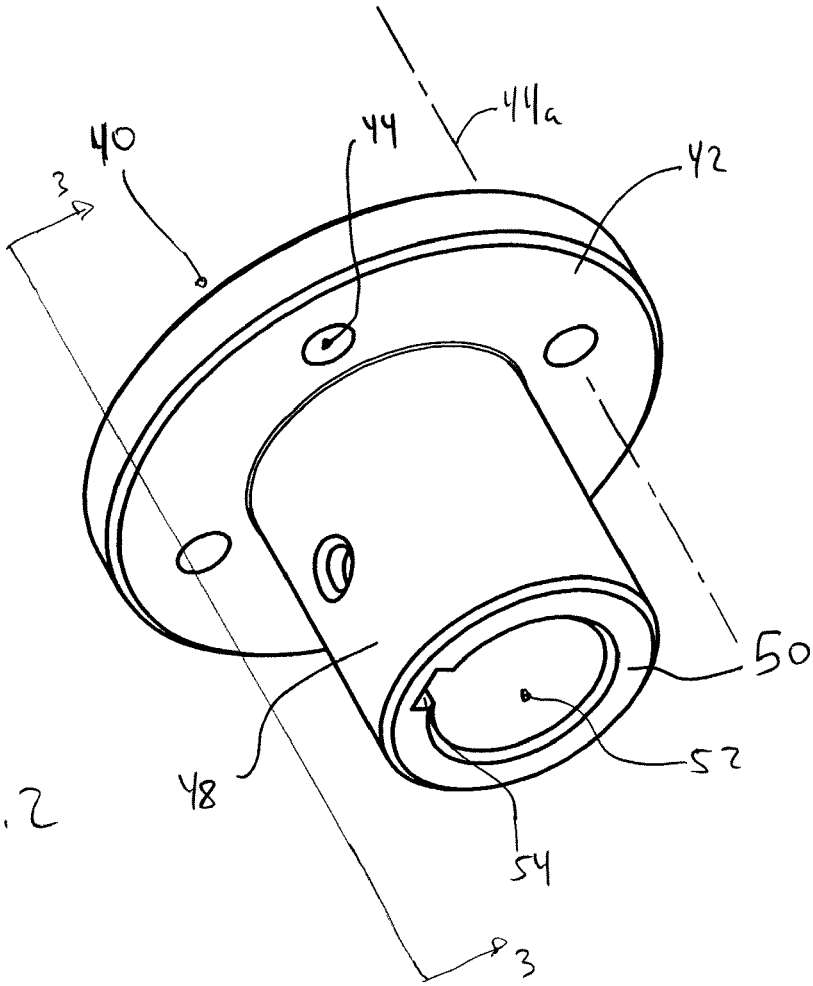
FIG. 2 is a perspective view of an inner hub of the removable blower wheel of FIG. 1.

As best shown in FIGS. 2-3, a first, or inner hub 40 is removeably connected to the distal end 24 of the motor shaft 22. Specifically, the first hub 40 includes a hollow central portion 52 that is sized to fit around the distal end 24 of the motor shaft 22. The hollow central portion 52 may include a keyway 54, a spline, or another similar structure to engage the corresponding structure for transferring torque on the motor shaft 22. In other embodiments, both the first hub 40 and the motor shaft 20 may include tapped holes (not shown) each adapted to receive a set screw (not shown) to engage the motor shaft 22 and the first hub 40 together. The structure to engage each of the distal end 24 of the motor shaft 22 and the first hub 40 is preferably formed such that the end surface of the distal end 24 of the motor shaft 22 extends along the same plane as the end surface 50 of the protruded portion 48 of the first hub 40.

The first hub 40 includes a disc portion 42 and a protruded portion 48. The hollow central portion 52 extends through the centers of both of the disc and protruded portions 42, 48. The first hub 40 includes a plurality of apertures 44 that are formed on the disc portion 42. The apertures 44 may be aligned along a circle that surrounds and is coaxial with the protruded portion 48. Each of the apertures 44 are preferably formed at the same radius from the centerline 41 of the hub 40. Additionally, the apertures 44 are each also preferably formed at consistent arc lengths from adjacent apertures 44 around the circumference of the first hub 40. For example, in some embodiments, the first hub 40 includes four apertures 44 that are each separated from the adjacent radial apertures by an arc length of substantially ninety degrees. In other embodiments, the first hub 40 includes three apertures 44 that are each separated from adjacent apertures 44 by an arc length of substantially one hundred and twenty degrees. In other embodiments, the first hub 40 may include other numbers of apertures 44 separated at corresponding arc lengths.

Figure 4:
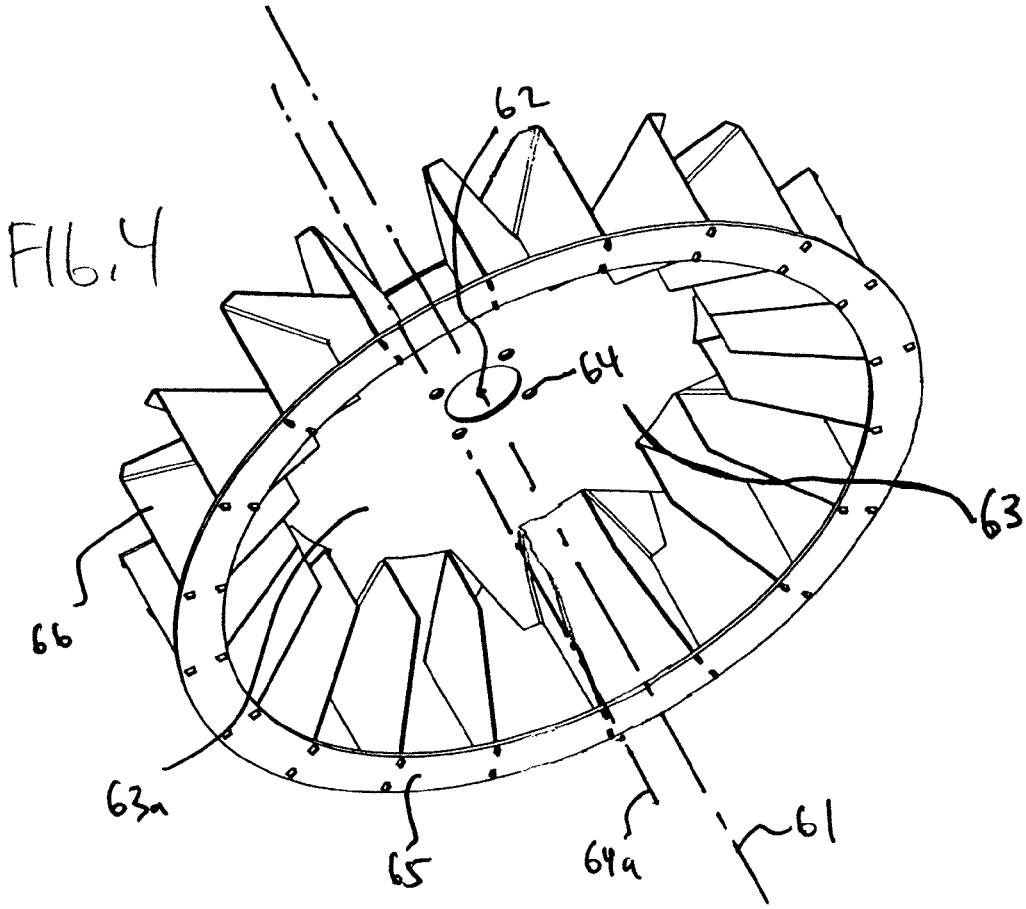
FIG. 4 is a perspective view of the blower wheel of FIG. 1.

As shown in FIG. 4, the blower wheel 60 is formed with a center plate 63 and a fan plate 65 and includes a plurality of vanes 66 disposed between the center and fan plates 63, 65. The vanes 66 are normally formed such that the blower wheel 60 is operable to direct air through the convection oven with the motor shaft 22 being rotated in either direction. Accordingly, the vanes 66 are normally formed as straight vanes 66. In other embodiments, the vanes 66 may be formed with a different shape to create more efficient air flow in a specific rotational direction of the motor shaft 22.

The center plate 63 includes a central aperture 64 that is formed with a slightly larger diameter than the outer diameter of the protruded portion 48 of the first hub 40. When the blower wheel 60 is connected with the first hub 40, the rear surface 63*b* of the center plate 63 contacts the forward surface 42*a* of the disc portion 42 of the first hub 40.

The blower wheel 60 additionally includes a plurality of apertures 64 that are formed around the central aperture 62. Preferably, blower wheel 60 includes the same number of apertures 64 as the number of apertures 44 provided in the first hub 40. Additionally, the apertures 64 are preferably provided at the same radius from a centerline 61 of the blower wheel 60 and at the same arc length between adjacent apertures 64 as the apertures 44 of the first hub 40. Accordingly, when the blower wheel 60 and the first hub 40 are mated and properly aligned, the centerlines 44*a* of the apertures 44 of the first hub 40 and the centerlines 64*a* of the plurality of apertures 64 of the blower 60 are co-linear.

Figure 6:
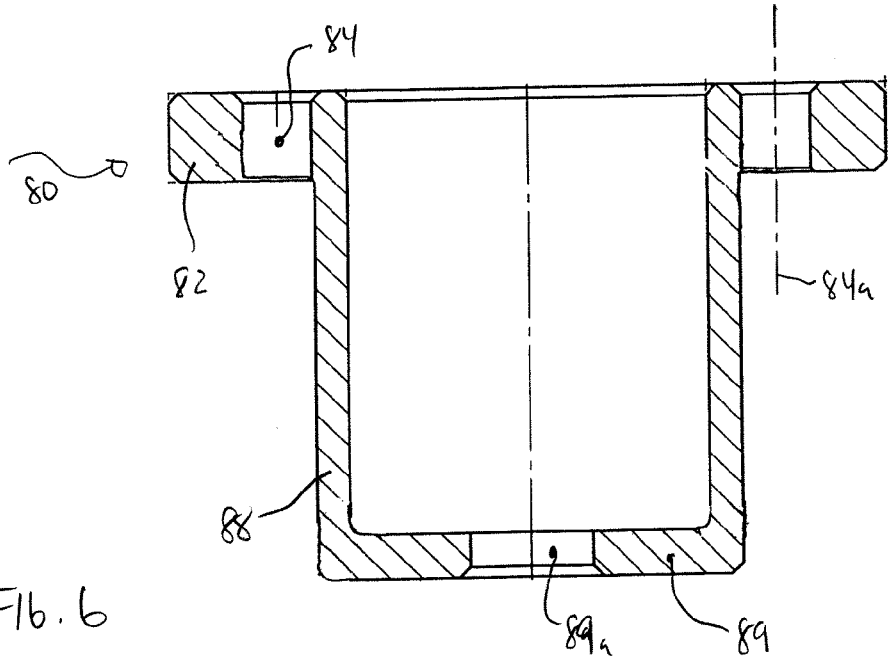
FIG. 6 is a cross-sectional view of the second hub of FIG. 5 along section 6-6.
Figure 5:
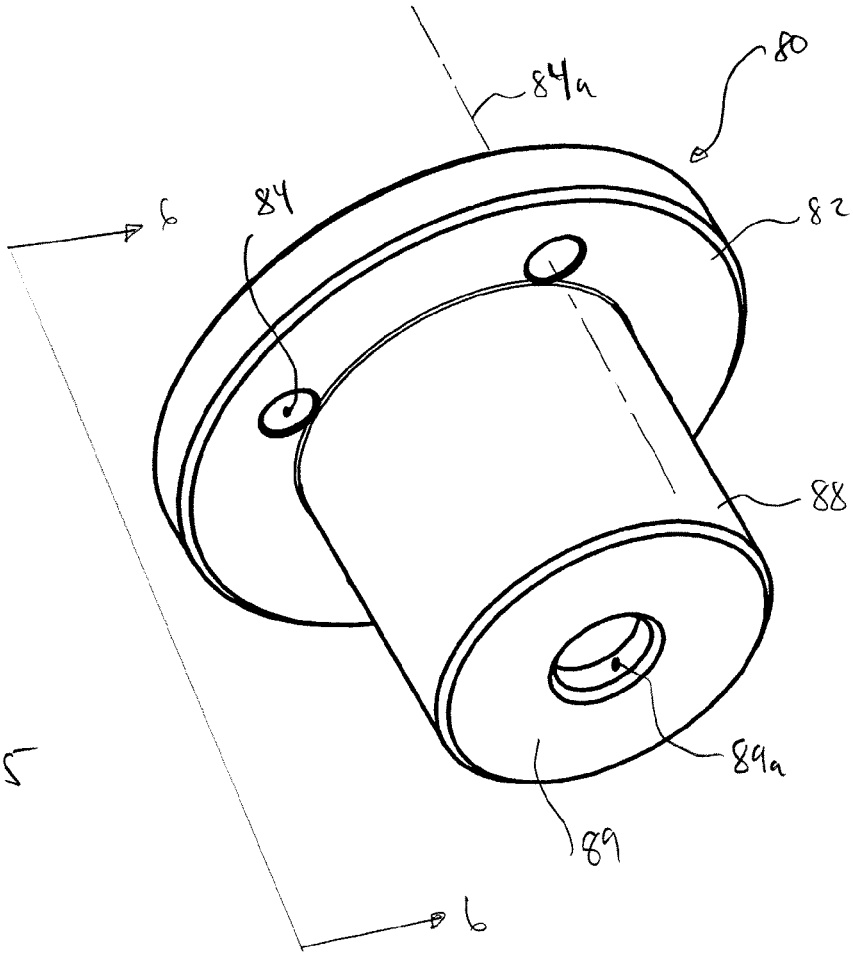
FIG. 5 is a perspective view of the second hub of FIG. 1.

Turning now to FIGS. 5-6, second hub 80 is provided that includes a disc portion 82 and a protruded portion 88. Each of the disc and protruded portions 82, 84 of the second hub 80 are hollow with a circular cross-section. As best shown in FIG. 7, the inner diameter of the majority of the hollow portion of the second hub 80 is slight larger than the outer diameter of the protruded portion of the first hub 40. The protruded portion 88 of the second hub 80 includes a front end 89 that includes a central aperture 89*a* that is substantially larger than the inner diameter of the recessed portion 26 on the distal end 24 of the motor shaft 22. As best shown in FIG. 8, when each of the motor shaft 20, first hub 40, blower wheel 60, and second hub 80 are assembled, the distal end 24 of the motor shaft 22 contacts the inner surface 89*b* of the front end of the protruded portion 88 of the second hub 80.

The second hub 80 includes a plurality of apertures 84 disposed on the disc section 82. Preferably, the apertures 84 are positioned at the same relative positions with respect to the centerline 81 of the second hub 80 as the apertures 44 of the first hub 40 are positioned with respect to the centerline 41 of the first hub 40. Accordingly, when the first hub 40, blower wheel 60, and second hub 80 are each aligned, the centerlines 44*a*, 64*a*, 84*a* of each respective aperture 44, 64, 84 are collinear.

Figure 1:
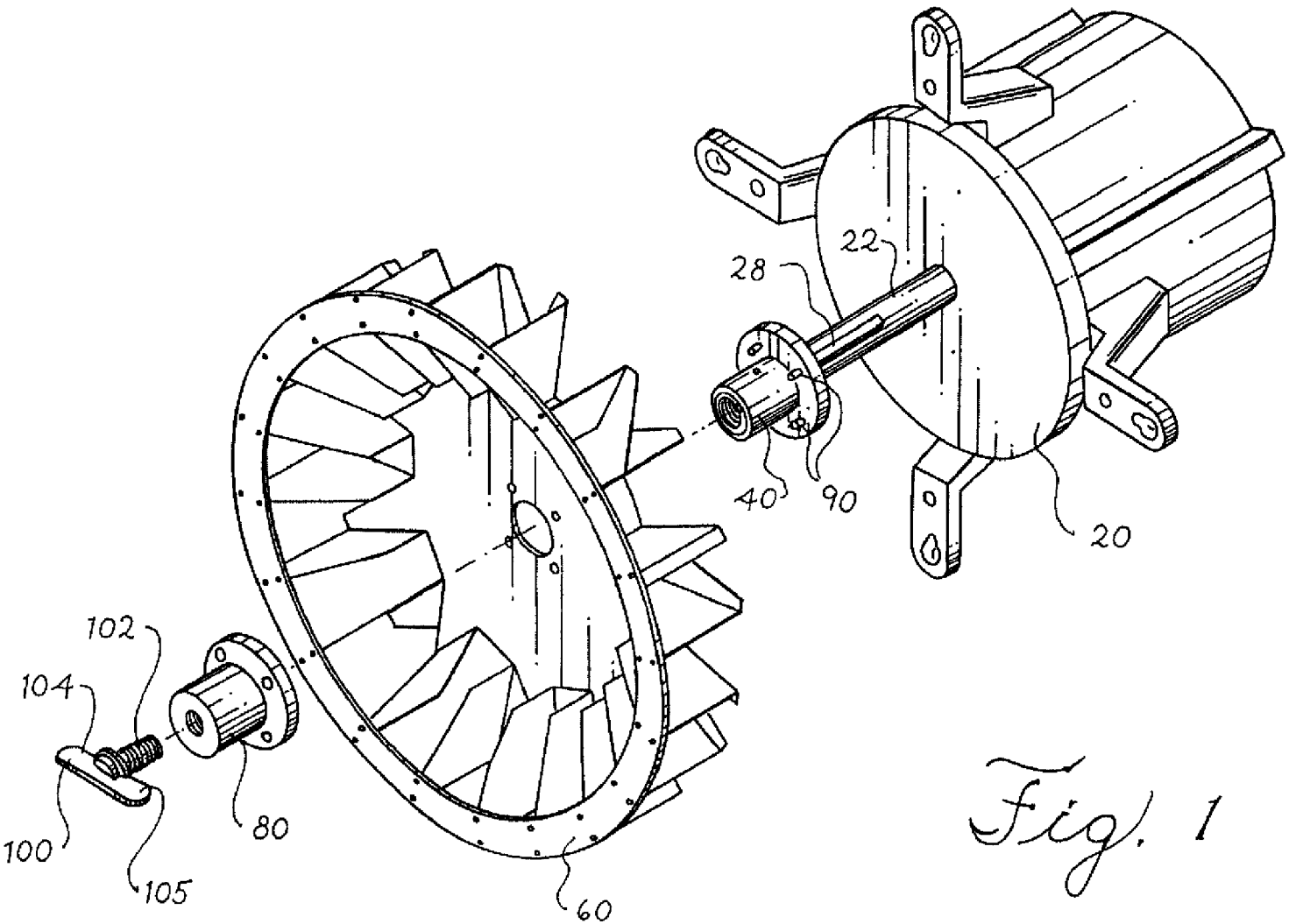
FIG. 1 is an exploded view of the components of the removable blower wheel.

A plurality of shafts 90 are provided that extend through each of the apertures 44, 64, 84 to maintain each of the first hub 40, blower wheel 60, and second hub 80 in alignment when these components are assembled, such that the motor shaft 22 torque is transferred to the blower wheel 60. In some embodiments as shown in FIGS. 1 and 8, the plurality of shafts 90 may each be rigidly, or permanently, mounted to the apertures 44 in the first hub 40. For example, the apertures 44 in the first hub 40 may be tapped with internal female threads (not shown) that can engage with similar male threads (not shown) on an end portion of the shafts 90. Alternatively, the plurality of shafts 90 may be positioned within the apertures 44 in the first hub 40 and spot welded or brazed into position. Accordingly, as the blower wheel 60 and the second hub 80 are mated to the first hub 40, the plurality of shafts 90 extend through the respective radial holes 64, 84 on the blower wheel 60 and the second hub 80, respectively, to prevent relative rotation between the three components.

Figure 11D:
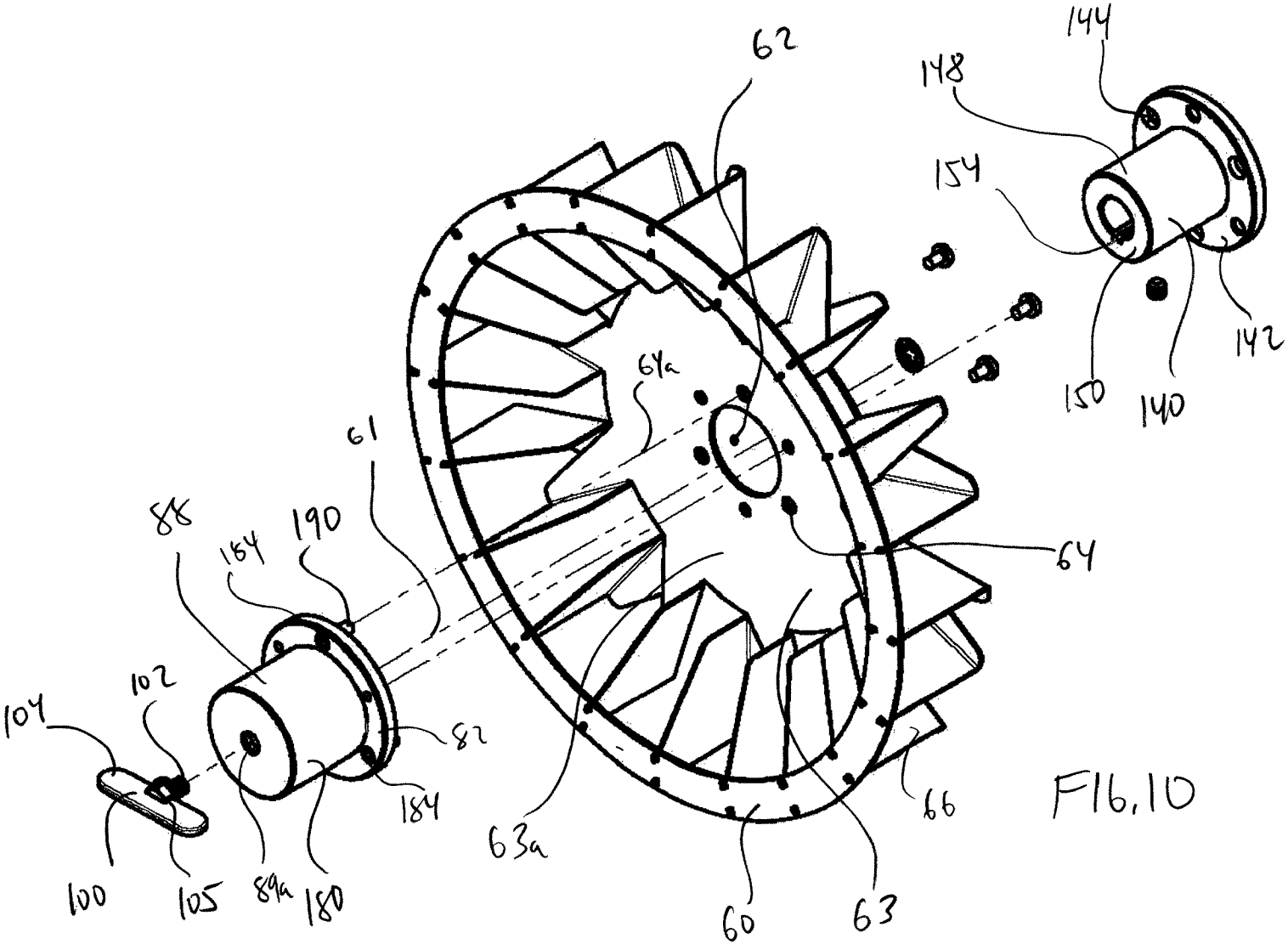
FIG. 11*a* is a rear perspective view of the second hub of the blower wheel of FIG. 10.
FIG. 11*b* is a front perspective view of the second hub of FIG. 11*a*.
Figure 11B:
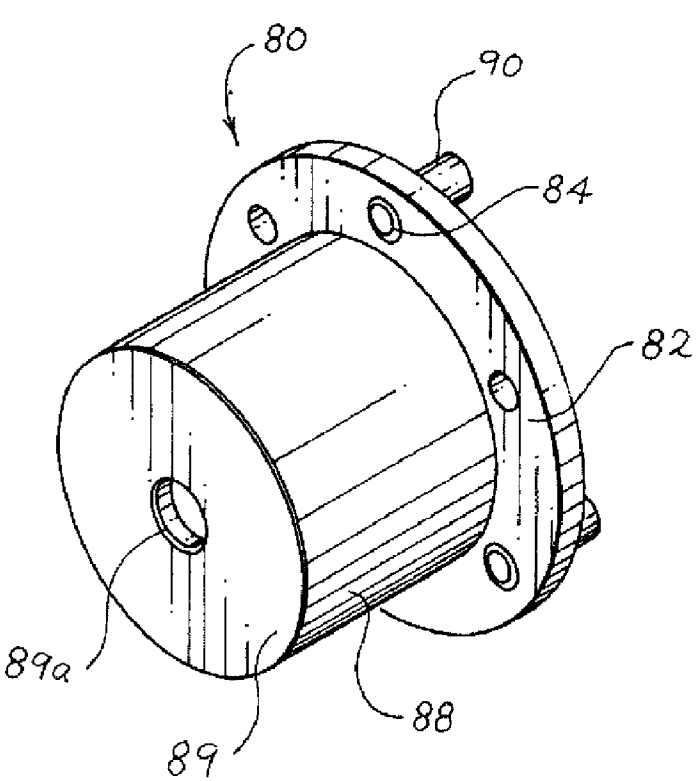
Figure 11A:
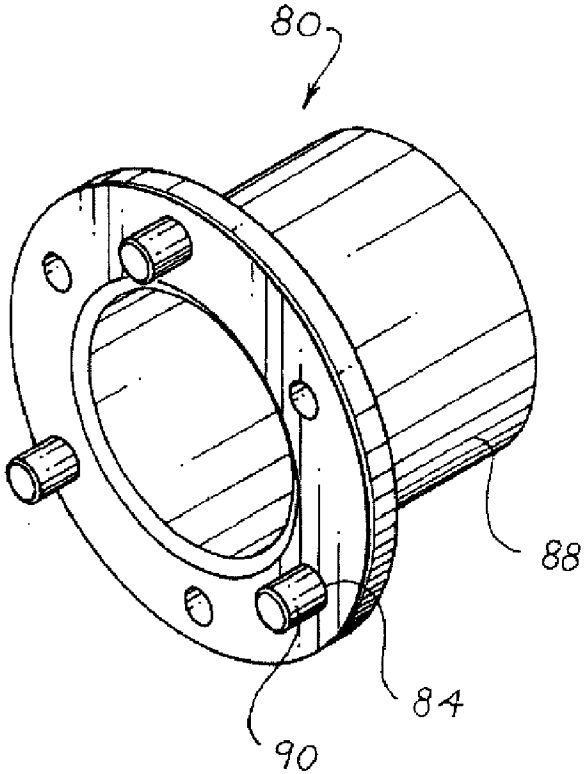

In other embodiments as shown in FIGS. 10-11*b*, the plurality of shafts 90 may be mounted (either rigidly, or permanently, or with a releasable connection as discussed above) with the respective plurality of apertures 84 in the second hub 80. The plurality of shafts 90 should be disposed therein to extend through each of the respective plurality of apertures 64 in the wheel 60 and the plurality of apertures 44 in the first hub 40. In other embodiments, the plurality of shafts 90 may be mounted to the plurality of apertures 64 in the wheel 60. The plurality of shafts 90 should be disposed within the respective apertures 64 such that a portion of each shaft 90 extends on opposite sides 63*a*, 63*b* of the center plate 63 to allow for receipt in each of the plurality of apertures 84 in the second hub 80 and the plurality of apertures 44 in the first hub 40.

Turning now to FIGS. 1 and 7, a fastener 100 is provided and includes a male inserting end 102 and a head 104. The male end 102 is formed with a slightly smaller outer geometry than the inner geometry of the recessed portion 26 of the motor shaft 22. In some embodiments, the recessed portion 26 of the motor shaft 22 may be formed with internal female threads and the male end 102 may be formed with corresponding male threads. In other embodiments, the recessed portion 26 may include an internal key that is engageable with a corresponding keyway on the male end 102 of the fastener 100, or the two components may be formed with one or more flats that prevent relative rotation between the two. The head 104 of the fastener 100 is formed with a larger diameter than the recessed portion 26 of the motor shaft 22 as well as the central aperture 89 in the protruded portion 88 of the second hub 80.

When the fastener 100 engages the motor shaft 22, the head 104 presses against the second hub 80, which maintains all of the components of the removable blower wheel 10 in alignment. The head 104 may be formed with the arms 105 similar to the wings that extend from a wing nut to allow the user to grasp and manipulate the fastener 100 without any external tools. Alternatively, the head 104 may be formed to receive a typical Phillips or slotted screwdriver, or may be formed to receive an Allen wrench or another type of driver. In other embodiments, the head 104 may be formed to allow the user to easily remove and reinstall the fastener 100 onto the motor shaft.

In some embodiments, a spring washer 108, such as a Belleville washer, may be provided between the head 104 of the fastener 100 and the front end 89 of the protruded portion 88 of the second hub 80. This spring washer 108 provides compressive force, which compresses the blower wheel 60 between the first hub 40 and the second hub 80. Due to the incorporation of this spring washer 108, the components of the removable blower wheel 10 may be assembled for use, with minimal torque placed on the fastener 100. Specifically, through experimental testing, it has been found that the blower wheel 60 is adequately retained by the first and second hubs 40, 80 for use at the normal rotational speed of the motor 20, which is between approximately 500 and 2500 RPM, depending on the type of convection oven 11 and the cooking setting used, when the fastener 100 is only retained to the motor shaft 22 at a "finger tight" torque level, or a torque level of between approximately 6 to approximately 10 foot pounds.

While the preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

What is claimed is:

1. A removable blower wheel assembly comprising:

(a) a first hub including a disc portion and a protruded portion and a plurality of shafts extending from the disc portion of the first hub, wherein a central aperture is defined through the disc and protruded portions, wherein the disc portion is configured to receive the plurality of shafts that extend in parallel to the protruded portion;

(b) a blower wheel defining a central hole and a plurality of first apertures spaced outward from the central hole, wherein the protruded portion of the first hub extends through the central hole;

(c) a second hub including a disc portion and a protruded portion, wherein the protruded portion of the first hub extends within and through a portion of the protruded portion of the second hub, and a plurality of second apertures defined in the second hub, wherein the plurality of first and second apertures are coaxially aligned and receive the plurality of shafts when the first hub, blower wheel, and second hub are engaged.

2. The assembly of claim 1, wherein a portion of each of the plurality of shafts are inserted into a plurality of third apertures defined on the first hub.

3. The assembly of claim 2, wherein the plurality of shafts are removeably inserted through the plurality of third apertures of the first hub.

4. The assembly of claim 2, wherein the plurality of shafts are respectively substantially fixed to one of the plurality of first apertures, second apertures, or third apertures.

5. The assembly of claim 1, wherein a distal end of a motor shaft extends through the central aperture of the first hub, with an end surface of the distal end of the motor shaft being substantially flush with an end surface of the protrusion of the first hub when the first hub, blower wheel, and second hub are engaged together by the plurality of shafts.

6. The assembly of claim 2, wherein a centerline of each of the plurality of first, second, and third apertures are formed at the same radial distance from the central aperture of the first hub.

7. The assembly of claim 6, wherein each of the first, second, and third apertures are formed with a consistent arc length between each adjacent respective first, second, and third aperture.

8. A removable blower wheel assembly comprising:

(a) a first hub including a disc portion and a protruded portion and a plurality of shafts extending from the disc portion of the first hub, wherein a central aperture is defined through the disc and protruded portions, wherein the disc portion is configured to receive the plurality of shafts that extend in parallel to the protruded portion;

(b) a blower wheel defining a central hole and a plurality of first apertures spaced outward from the central hole, wherein the protruded portion of the first hub extends through the central hole;

(c) a second hub including a disc portion and a protruded portion, wherein the protruded portion of the first hub extends within and through a portion of the protruded portion of the second hub, and a plurality of second apertures defined in the second hub, wherein the plurality of first and second apertures receive the plurality of shafts when the first hub, blower wheel, and second hub are engaged, wherein a distal end of a motor shaft extends through the central aperture of the first hub, with an end surface of the distal end of the motor shaft being substantially flush with an end surface of the protrusion of the first hub when the first hub, blower wheel, and second hub are engaged together by the plurality of shafts, wherein the distal end of the motor shaft includes a female threaded portion that extends within motor shaft from the end surface.

9. The assembly of claim 8, further comprising a fastener with male threads that is engageable with the female threaded portion of the motor shaft to rigidly attach the first hub, the blower wheel, and the second hub each to the distal end of the motor shaft.

10. The assembly of claim 9, wherein the distal end of the motor shaft includes a key that engages a corresponding keyway formed in the central aperture of the first hub.

11. A convection oven comprising:

(a) a housing forming an internal cooking region;

(b) a motor with an output shaft that rotates during motor operation;

(c) a first hub including a disc portion and a protruded portion and a plurality of shafts extending therefrom substantially parallel to a rotational axis of first hub, wherein a central aperture extends through the disc and protruded portions; wherein the disc portion is configured to receive the plurality of shafts extending in parallel to the protruded portion;

(d) a blower wheel defining a central hole and a plurality of first apertures formed radially outward from the central hole, wherein the protruded portion of the first hub extends through the central hole;

(e) a second hub including a disc portion and a protruded portion, wherein the protruded portion of the first hub extends within and through the protruded portion of the second hub, and a plurality of second apertures defined in the disc portion of the second hub, wherein a centerline of each of the plurality of first and second apertures is coaxial with the centerlines of the respective other of the plurality of first and second apertures, and the plurality of shafts extend through the respective plurality of first and second apertures when a portion of the motor shaft extends through the first hub, the blower wheel, and the second hub.

12. The assembly of claim 11, wherein the plurality of first and second apertures are each formed at the same radial distance from a centerline of the central aperture of the first hub.

13. The assembly of claim 11, wherein each of the plurality of first and second apertures are formed with a consistent arc length between each adjacent respective first and second apertures and the respective shafts.

14. The assembly of claim 11, wherein the plurality of shafts are inserted through a plurality of third apertures defined within the disc portion of the first hub.

15. The assembly of claim 14, wherein each of the plurality of shafts are threaded and are engaged with corresponding female threads within one of the respective plurality of first, second, or third the third apertures.

16. The assembly of claim 11, wherein a distal end of the motor shaft extends through the central aperture of the first hub with an end surface of the distal end of the motor shaft being substantially flush with an end surface of the protrusion of the first hub when the first hub, blower wheel, and second hub are engaged.

17. The assembly of claim 16, wherein the distal end of the motor shaft includes a recessed portion that extends within the motor shaft from the end surface.

18. The assembly of claim 17, further comprising a fastener with a male portion that is engageable with the recessed portion on the distal end of the motor shaft.

19. The assembly of claim 16, wherein the motor shaft includes a key that engages a corresponding keyway formed in the central aperture of the first hub.

20. A removable blower wheel assembly comprising:

(a) a first hub including a disc portion and a protruded portion, wherein a central aperture extends through the disc portion and the protruded portion;

(b) a blower wheel defining a central hole to accept the protruded portion of the first hub;

(c) a second hub including a disc portion and a protruded portion, wherein the protruded portion of the first hub extends within and through the protruded portion of the second hub; and (d) a means to removeably connect each of the first hub, the blower wheel, and the second hub, the means comprising a plurality of first holes disposed around a circumference of the disc portion of the second hub, a plurality of second holes disposed around a circumference of the blower wheel that are each coaxially aligned with a respective one of the first holes when the first and second hubs are connected, and a plurality of shafts extending from the first hub that each extend through one of each of the first and second holes.

* * * * *